US007854404B2

(12) United States Patent
Riethorst et al.

(10) Patent No.: US 7,854,404 B2
(45) Date of Patent: Dec. 21, 2010

(54) PROCESS FOR YARN OR SLIVER REFINING

(75) Inventors: Gerrit Jan Riethorst, Oosterbeek (NL); Vincentius Antonius Van Bommel, Zevenaar (NL); Johannes Willem Dionysius Veeling, Veenendaal (NL); Ernst Michael Winkler, Arnhem (NL); Soon Joo Bovenschen, Arnhem (NL)

(73) Assignee: Teijin Aramid B.V., Arnhem (NL)

( * ) Notice: Subject to any disclaimer, the term of this patent is extended or adjusted under 35 U.S.C. 154(b) by 151 days.

(21) Appl. No.: 12/226,495

(22) PCT Filed: Apr. 21, 2007

(86) PCT No.: PCT/EP2007/003515

§ 371 (c)(1),
(2), (4) Date: Oct. 20, 2008

(87) PCT Pub. No.: WO2007/121956

PCT Pub. Date: Nov. 1, 2007

(65) Prior Publication Data

US 2009/0166453 A1 Jul. 2, 2009

(30) Foreign Application Priority Data

Apr. 26, 2006 (EP) ..... 06008636

(51) Int. Cl.
*B02C 19/00* (2006.01)

(52) U.S. Cl. ..... 241/21

(58) Field of Classification Search ..... 241/21, 241/261.2, 261.3
See application file for complete search history.

(56) References Cited

U.S. PATENT DOCUMENTS

| | | | | |
|---|---|---|---|---|
| 3,765,613 | A | 10/1973 | Steiniger | |
| 4,472,241 | A * | 9/1984 | Provost | 162/28 |
| 5,385,640 | A | 1/1995 | Weibel et al. | |
| 5,687,917 | A | 11/1997 | Law et al. | |

FOREIGN PATENT DOCUMENTS

DE 100 31 655 A1 1/2002

* cited by examiner

*Primary Examiner*—Faye Francis
(74) *Attorney, Agent, or Firm*—Oliff & Berridge, PLC

(57) ABSTRACT

The invention discloses a process for refining yarn or sliver having a length of at least 1 meter, including the step of feeding the yarn or sliver and a liquid into a refiner, which includes refiner fillings having a body surrounding a central hole (7), and at least one inlet (1) for the yarn or sliver, and the thus obtained pulp-like materials and its use for making friction materials, paper, and gaskets. In particular, the refiner has a refiner filling (8), wherein the yarn or sliver is fed through an inlet positioned in the refiner filling. The present invention further relates to the refiner filling including at least one, preferably eccentric, inlet for yarn or sliver. The inlet comprises an inlet hole which includes an inclined slope (2) on the outflow side of the inlet, the inclined slope serving to guide the yarn or sliver from the inlet hole to the surface of the refiner filling. The invention further relates to a refiner including such refiner filling.

7 Claims, 2 Drawing Sheets

PROCESS FOR YARN OR SLIVER REFINING

The present invention relates to a process of refining yarn or sliver, to a refiner filler, and to a refiner comprising said refiner filling.

Pulp, such as polyparaphenylene terephthalamide (PPTA) pulp, may be prepared by so-called refining, comprising cutting fiber to obtain the desired fiber length accompanied by fibrillating the fiber to give it a rough or hairy appearance.

Currently, refining fiber requires a pretreatment of the fiber, wherein the (semi-)continuous fiber is precut to obtain individual fiber fragments of appropriate short size to enable preparing a liquid suspension. Typically, fiber coming out of a fiber spinning process is wet. The pretreatment of cutting requires that the fiber is dried, since the cutting of wet (never dried) fiber is not feasible because the knives will easily break. This is a disadvantage, not only for economical reasons but also because it is well known that the product (pulp) properties improve by using "never dried" fiber as basic material. According to the known refining processes, after drying and cutting the precut fiber is suspended in a liquid and the resulting suspension is centrally fed into the refiner.

It would be desirable to be able to dispense from the drying step that is necessary to allow precutting the fiber. It would also be desirable to delete the precutting step, since high speed cutting of dry fiber is difficult and the cutting knives show much wear. In addition, some cutting techniques may cause undesired objects, such as agglomerates of fiber.

To address the above needs, the present invention discloses a process wherein drying and precutting fiber, such as yarn or sliver, are not a prerequisite for a practical performance. The invention advantageously allows the refining of wet, never dried yarn or sliver containing never dried fiber that is directly obtained from a fiber spinning process Thus, in a first aspect, the present invention provides a process for refining yarn or sliver having a length of at least 1 meter, comprising the step of feeding the yarn or sliver and a liquid into a refiner, which comprises refiner fillings having a body surrounding a central hole, and at least one inlet for the yarn or sliver. The yarn or sliver thus is not fed into the refiner in the form of a suspension of short yarn or sliver fragments.

Processes for pulp refining are known in the art. In U.S. Pat. No. 5,687,917 a refiner-apparatus and method for producing refined pulp by exerting mechanical forces on pulp fibres have been described. The apparatus includes a member having a plurality of drainage conduits, each drainage conduit having inlet and outlet openings, respectively. The inlet openings are disposed on the pulp side of the member and the outlet openings are disposed on the drainage side of the member such that water expelled from pulp fibres forced against the pulp side is received in the inlet openings. These openings are unsuitable for guiding yarn or sliver to the refiner, because the inlet openings are positioned on the wrong side of the refiner, and further because these openings are smaller than 1 mm and therefore much too small to use as openings for yarn or sliver.

In DE 100 31 655 a method was disclosed for the production of cellulose particles by means of dispersing a cellulose solution in a precipitant, in addition to a device for carrying out this method. The device is characterized in that it contains a disk refiner, which has axial boreholes in the stator disk and plate for the introduction of the precipitant. These boreholes are used for introducing the precipitant liquid, not for introducing yarn or sliver, and further do not contain an inclined slope to guide the yarn or sliver from the inlet hole to the surface of the refiner filling.

Yarn or sliver used according to this invention encompasses yarn or sliver in the form of bundles of long polymeric filaments having the same length. Preferably the yarn is continuous yarn having a length of at least 1 m, but preferably much longer, such as at least 10 m, more preferably at least 100 m. The yarn may be twisted or untwisted yarn. In another embodiment according to the invention, the sliver is in the form of bundles of overlapping filaments having the same or different lengths, e.g. varying from about 30 to about 1000 mm. Such fiber is called sliver. Although the individual filaments may be much shorter, the sliver has a length of at least 1 m, preferably as at least 10 m, more preferably at least 100 m.

The yarn or sliver may in principal be any yarn or sliver, such as natural yarn or sliver including cellulose, hempen, cotton or wool, or may be artificial yarn or sliver, such as aramid, polyamide, polyester, or polyacrylonitrile (PAN). Preferably, the yarn or sliver is aramid or sliver, more preferably poly-paraphenylene terephthalamide (PPTA) yarn or sliver.

Yarn or sliver and liquid are fed together to the refiner in such a way to ensure that the yarn or sliver is guided as a thread into the refiner and to the surface of the refiner filling, and that a suspension of yarn or sliver fragments leaves the refiner at the outward side of the refiner, the suspension comprising suitably cut and fibrillated yarn or sliver fragments. The speed wherein the yarn or sliver is fed into the refiner typically will depend on the thickness of the yarn or sliver, and can easily be adjusted by the skilled man to obtain the required pulp material. The speed may be regulated by adjusting the speed of the rotating counter disc (rotor) of the refiner and/or, optionally, through the use of a feeding device, such as a pressed transport duo roll system.

The yarn or sliver may be centrally fed into the refiner. Care should be taken that the speed wherein yarn or sliver is fed into the refiner is such that adequate transport of the yarn or sliver occurs and unrefined yarn or sliver does not accumulate inside the refiner.

In a preferred embodiment of the invention, the yarn or sliver is eccentrically fed into the refiner. The term "eccentric" means that the inlet is not positioned at the center of the circular refiner, but at a certain distance there from. Eccentric feeding for instance can be done through an inlet that is positioned in a refiner filling. Such positioning of a yarn or sliver inlet in the refiner filling advantageously ensures a more easy transport of the yarn or sliver into the refiner and to the surface of the refiner filling and decreases the risk of yarn or sliver accumulation in the refiner.

In an especially preferred embodiment, the yarn or sliver is fed into a refiner through an inlet that is positioned in a refiner filling as is provided in a further aspect of this invention to have an inclined slope on the outflow side of the inlet, the inclined slope serving to guide the yarn or sliver from the inlet hole to the surface of the refiner filling.

The liquid that is fed to the refiner may be any liquid that is suitable to facilitate transport of the yarn or sliver and/or to function as cooling liquid. The amount of liquid fed to the refiner depends among others on the dimensions of the equipment used. Typically, an amount of liquid is fed to the refiner that enables production of a yarn or sliver suspension of 0.1-10% (w/w). If the inlet hole for the yarn or sliver is not centrally positioned in the refiner, it is possible that part of the liquid is fed into the refiner using the inlet hole and part is centrally fed into the refiner. Preferably, the liquid fed to the refiner is water. In a further preferred embodiment the water is fed to the refiner using one or more water jets. These water jets are constructed to give a water stream in the direction of the refiner, and the jetted water has such speed that due to under pressure the water carries the yarn or sliver to the inlet of the refiner. This leads to a smooth transport of the yarn or sliver to the refiner. The water speed in the feeding direction therefore is at least as great as the feeding speed of the yarn or sliver but usually higher.

The invention advantageously allows freedom to add certain additives to the liquid that is fed into the refiner. Thus in an embodiment according to the invention, the liquid fed into the refiner comprises a finish. Finish typically is an oily material that may be applied as a processing aid and/or to improve functional properties of the refined pulp. Suitable compounds to be used as finish for instance are ethoxylated fatty acid esters, and mixtures of ethoxylated alcohol, propoxylated alcohol (alcohols such as butanol), and ethoxylated or propoxylated fatty alcohols. For instance, finish improves smoothness of the pulp and/or improves its isolating and/or antistatic properties. However, for applications wherein the content of finish should be low or wherein finish should preferably be absent, the present invention advantageously allows the refining of yarn or sliver without adding any finish. For instance, a low or even zero level of finish is advantageous for pharmaceutical, food, and paper applications.

In another embodiment according to the invention a neutralizing agent may be added as additive, for instance to neutralize acid residues that are present in aramid yarn or sliver as remainders from the manufacturing process. The liquid may also contain mixtures of additives.

In a further aspect, the present invention provides a process for the preparation of pulp comprising the previously mentioned refining process. The suspension obtained by the process may be further processed to obtain a pulp or pulp-like material that can be used for various applications. Further processing may comprise dewatering and/or drying steps as known in the art.

In another embodiment, the yarn or sliver suspension obtained from the refining process is fed to another refiner, i.e. is subjected to a regular refining step comprising feeding the yarn or sliver suspension to said other refiner.

In still a further aspect, the present method uses a refiner filling comprising a body surrounding a central hole, the body comprising the active refining surface and bolt holes for mounting the refiner filling in the refiner, characterized in that the body further comprises at least one inlet for feeding yarn or sliver into the refiner. The central hole may be used for pulp to enter the refiner. In some arrangements, it is also possible that pulp leaves the refiner through the central hole. The inlet for feeding yarn or sliver preferably has a diameter and form, and a position in the refiner filling, suitable to guide the yarn or sliver into the refiner and to the active surface of the refiner filling and to ensure that the pulp that leaves the refiner is suitably cut and fibrillated.

The refiner filling may comprise one or a multitude of yarn or sliver inlets, such as 1 to 5 inlets, or more.

The inlet may be positioned in the body of the refiner filling at any position that ensures suitable processing of the yarn or sliver to pulp. The positioning of the yarn or sliver inlet may depend on the positioning of the pulp outlet. For instance, if pulp leaves the refiner at the downward side, the position of the yarn or sliver inlet may be closer to the inside edge than to the outside edge of the refiner filling, to allow a proper contact of the yarn or sliver with the surface-located blades of the refiner filling.

In another embodiment the invention also pertains to a filling wherein the yarn or sliver inlet comprises an inlet hole and an inclined slope on the outflow side of the inlet at the active surface of the refiner filling. The inclined slope is made in such a way that it serves to guide the yarn or sliver from the inlet hole to the surface-located blades of the refiner filling.

The invention is illustrated by the Figures.

Figure 1:
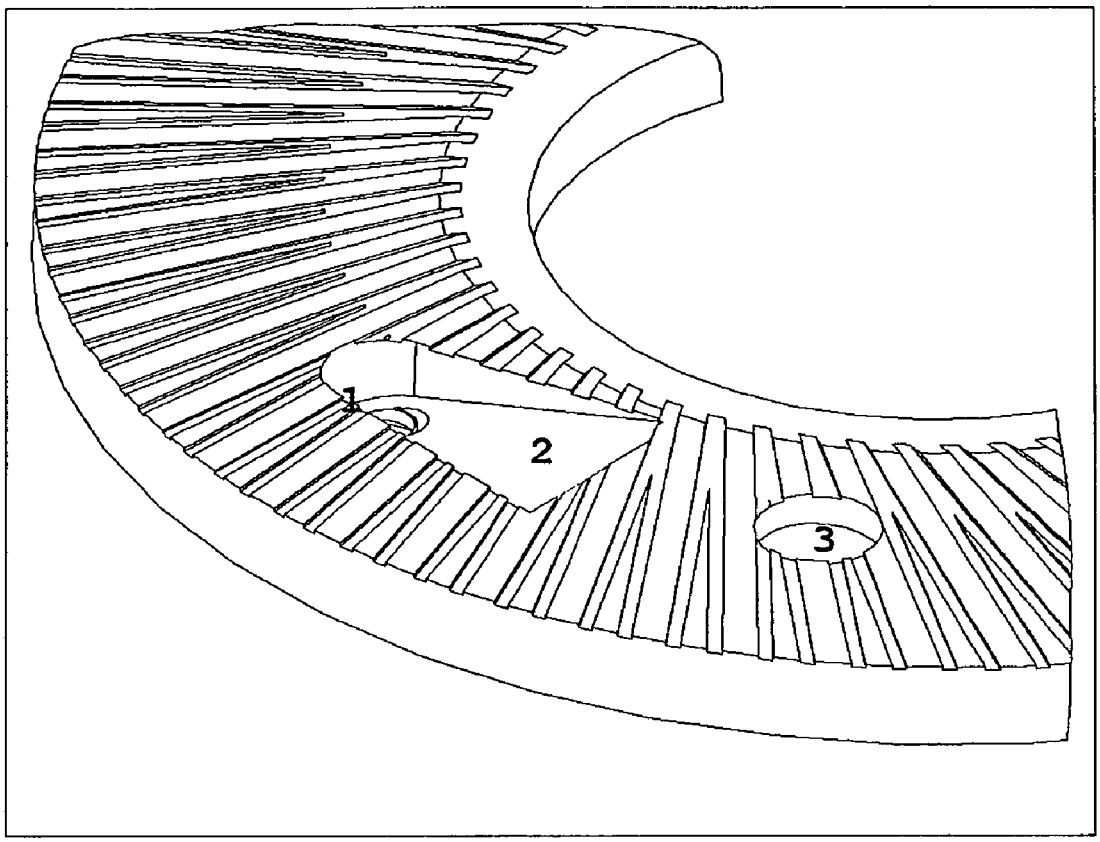
FIG. 1 shows a part of a refiner filling.
Figure 2:
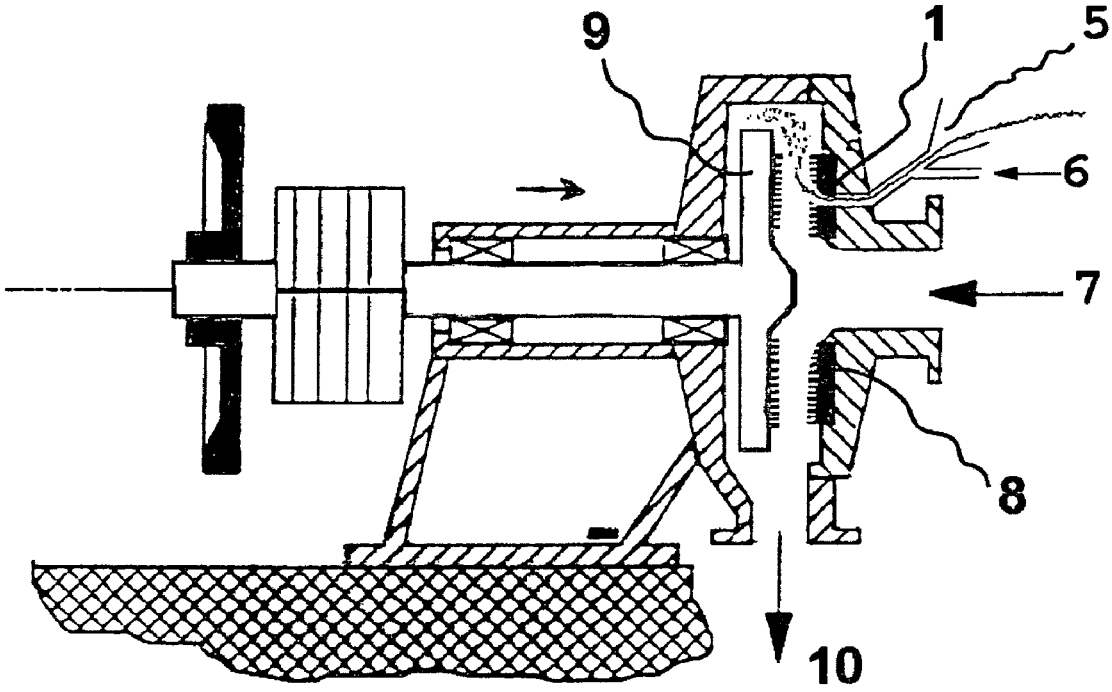
FIG. 2 shows a cross section of a refiner comprising the refiner filling of FIG. 1.

FIG. 1 shows part of a refiner filling comprising an inlet hole 1 and an inclined slope 2. The complete filling may be a disc that is circular of shape. The hole 3 is a bolt hole for mounting the refiner filling in the refiner. The refiner filling will normally contain various holes 3 to secure the filling into the refiner. The refiner filling may contain more than one inlet hole 1, which holes preferably are provided with inclined slopes 2. The inclined slope serves to guide the yarn or sliver from the inlet hole to the surface of the refiner filling. It is however not necessary to use such slopes, and fillings having inlet holes without slope can also be used. Apart from holes 1 with slopes 2 refiner fillings are well known in the art. The refiner may be of the stator-rotator type, preferably of the single disc, conical, triconical, or papillon type. In a stator-rotator type refiner, the refiner filling of the invention is the stator disc. An example of a refiner according to the invention is the refiner as shown in FIG. 2. This refiner comprises a stator disc 8 with an inlet 1 for yarn or sliver 5 and water 6. In this embodiment water may also be supplied through the central hole 7. Yarn or sliver suspension leaves the refiner at the product outlet 10 by gravity discharge. The refiner also comprises a rotating counter disc or rotor 9.

The refining according to the invention results in pulp with improved properties and improved performance in various applications. For instance, the pulp has low ion content, improved dye ability, and/or low finish content. Therefore the invention also relates to a method for making friction materials, paper, or gaskets wherein the pulp-like fibers of the invention are applied in the conventional manners for making friction materials, paper, and gaskets, and to these materials as such. In paper application, the pulp results in improved filler retention, gasket strength, and paper strength. In addition, the paper is less porous and has a good processing and mechanical performance regarding friction.

EXAMPLES

Equipment

- 12" Sprout Waldron Single Disc Laboratory Refiner
- Power: 50 kW
- Operating power 5-25 kW
- 1500 RPM
- Filler pattern Andritz D2A504 like
- Diameter inlet hole in stator disc: 11 mm
- Length of inlet hole 25 mm, width from 11 (beginning of slot at hole) to 22 mm (end of slot) and an angle of about 15°.

General Process Conditions

- Central water flow: 100 L/mm
- Eccentric water flow (goes together with the yarn or sliver to inlet hole): 0.1-1.0 L/min.
- Water temperature: 20° C.

Test Methods

Yarn or Sliver Length Measurement

Yarn or sliver length measurement was done using the Pulp Expert™ FS (ex Metso). As length the average length (AL), the length weighted length (LL), weight weighted length (WL) were used. The subscript 0.25 means the respective value for particles with a length >250 micron. The amount of fines was determined as the fraction of particles having a length weighted length (LL) <250 micron. This instrument was calibrated with a sample with known yarn or sliver length. The calibration was performed with commercially available pulp as indicated in Table 1.

TABLE 1

| Commercially available samples | AL mm | LL mm | WL mm | $AL_{0.25}$ mm | $LL_{0.25}$ mm | $WL_{0.25}$ mm | Fines % |
|---|---|---|---|---|---|---|---|
| A | 0.27 | 0.84 | 1.66 | 0.69 | 1.10 | 1.72 | 26.8 |
| B | 0.25 | 0.69 | 1.31 | 0.61 | 0.90 | 1.37 | 27.5 |
| C | 0.23 | 0.78 | 1.84 | 0.64 | 1.12 | 1.95 | 34.2 |

A Kevlar ® 1F539, Type 979, Bale 102401587
B Twaron ® 1095, Charge 315200, 24 Jan. 2003
C Twaron ® 1099, Ser. no. 323518592, Art. no. 108692

SR (EN ISO 5267-1:2000)

2 g (dry weight) of never dried pulp yarn or slivers were dispersed in 1 L water during 250 beats in a Lorentz and Wettre desintegrator. A well-opened sample is obtained. The Schopper Riegler (SR) value is measured. (EN ISO 5267-1: 2000).

Specific Surface Area (SSA) Determination

Specific surface area ($m^2/g$) was determined using adsorption of nitrogen by the BET specific surface area method, using a Tristar 3000 manufactured by Micromeretics. The dry pulp yarn or slivers samples were dried at 200° C. for 30 minutes, under flushing with nitrogen.

Paper Strength

Hand sheets (300 $g/m^2$) were made of 80% Twaron® pulp and 20% latex. Tensile index (Nm/g) was measured according to ASTM D828 and Tappi T494 om-96 on dried paper (120° C.), wherein sample width is 15 mm, sample length 100 mm, and test speed 10 mm/min at 21° C./65% RH conditions.

Filler Retention

A mixture of 97% Kaolin (Laude SP 20) and 3% Twaron® pulp was prepared on a high-speed vertical mixer. 20 g of the mixture were sieved on a riddle sifter device using a 250 mesh sieve. The remaining material on the sieve given as percentage of the initial amount was determined.

Green Strength

A mixture of 97% Kaolin (Laude SP 20) and 3% Twaron® pulp was prepared on a high-speed vertical mixer. 10 g of the mixture were molded at 70 bar to a rod with a thickness between 7.5 and 11.0 mm and a width of 15 mm. The rod was fractured on a pendulum ram impact testing device perpendicular to its main axis. The Green strength is given as [$mJ/mm^2$].

Gasket Strength

A gasket sheet was prepared on the two roll gasket calendar under defined conditions. The gasket compound consists of NBR rubber, inorganic fillers and 12% Twaron® pulp. The tensile strength of this gasket was determined according to DIN 52910 longitudinal and traversal to the roll direction. The tensile strength is given in MPa.

Example 1

This example describes four experiments. In these experiments four different raw materials were processed to pulp. The different raw materials were dry and wet (never dried) yarn and sliver. The conditions and results of the refining according to the invention are shown in Table 2. The outcome of this refining was yarn or sliver with different lengths, suspended in water. This yarn or sliver suspension was subjected to a further processing step that compares to a regular refiner treatment, wherein yarn or sliver suspension was fed to a refiner. The conditions and results of this process are shown in Table 3. The outcome of this process is a pulp comparable to a commercial pulp. The experiments were performed on a lab-scale refiner.

Measurements that were performed on the obtained pulp show that the use of never dried yarn improves the pulp quality. The SR and paper strength values are higher, which is important for paper applications. The filler retention value is higher, which is important for friction applications. The gasket applications show higher gasket strength.

TABLE 2

| | Properties before refining | | | | | Properties after direct refining | | |
|---|---|---|---|---|---|---|---|---|
| | | | | | | Yarn or | | |
| Exp. No. | Raw material Twaron | Linear density | Bundle diameter (mm) | Dry solids (%) | Inlet speed (m/min) | Specific Surface Area SSA ($m^2/g$) | sliver length $LL_{0.25}$ (mm) | Specific refiner energy CSE (kJ/Kg) |
| 1 | Wet yarn | 1680 dtex | 0.8 | 45 | 900 | 2.02 | 1.61 | 2520 |
| 2 | Dry yarn | 1680 dtex | 0.5 | 95 | 900 | 2.86 | 1.48 | 1770 |
| 3 | Wet sliver | 4 ktex | 8 | 30 | 30 | 0.56 | 1.84 | 1890 |
| 4 | Dry sliver | 4 ktex | 8 | 95 | 60 | 0.67 | 1.80 | 1800 |

TABLE 3

| Exp. No. | Raw material Twaron | Specific Surface area SSA ($m^2/g$) | Yarn or sliver length LL0.25 (mm) | Specific refiner energy CSE (kJ/Kg) | Schopper Riegler (° SR) | Filler retention (%) | Green strength ($J/mm^2$) | Gasket strength (MPa) | Paper strength (Nm/g) |
|---|---|---|---|---|---|---|---|---|---|
| | Properties after regular refiner treatment (this treatment is performed after the direct refining step) | | | | | | | | |
| 1 | Wet yarn | 4.21 | 0.90 | 4527 | 32.00 | 75.90 | 1.08 | 32.00 | 30.00 |
| 2 | Dry yarn | 6.00 | 0.84 | 3288 | 24.00 | 41.00 | 0.87 | 27.00 | 27.00 |
| 3 | Wet sliver | 2.04 | 1.00 | 3395 | 15.00 | | | | 23.00 |
| 4 | Dry sliver | 3.56 | 0.95 | 2910 | 15.00 | | | | 22.00 |

The invention claimed is:

1. A process for refining yarn or sliver having a length of at least 1 meter, comprising the step of feeding the yarn or sliver and a liquid into a refiner, which comprises refiner fillings having a body surrounding a central hole, and at least one inlet for the yarn or sliver.

2. The process according to claim 1, wherein the yarn or silver is continuous yarn or silver.

3. The process according to claim 1, wherein the yarn or sliver is aramid yarn or sliver.

4. The process according to claim 1, wherein the yarn is never dried spun yarn or wherein the sliver contains never dried fiber.

5. The process according to claim 1, wherein the yarn or sliver is eccentrically fed into the refiner.

6. The process according to claim 1, wherein the yarn or sliver is fed to the refiner by a water jet having a water speed in the feeding direction that is at least as great as the feeding speed of the yarn or sliver.

7. The process according to claim 1, wherein the liquid comprises an additive selected from at least one of a neutralizing agent and a finish.

* * * * *